US006599364B2

(12) United States Patent
Méndez-Gallon

(10) Patent No.: US 6,599,364 B2
(45) Date of Patent: Jul. 29, 2003

(54) APPLICATOR

(75) Inventor: Benjamin Méndez-Gallon, Königsbronn (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/090,667

(22) Filed: Mar. 5, 2002

(65) Prior Publication Data

US 2002/0124796 A1 Sep. 12, 2002

(30) Foreign Application Priority Data

Mar. 6, 2001 (DE) ..... 101 10 633

(51) Int. Cl.[7] ..... B05C 5/02
(52) U.S. Cl. ..... 118/325; 118/50; 118/DIG. 4
(58) Field of Search ..... 118/50, 325, DIG. 4; 427/420

(56) References Cited

U.S. PATENT DOCUMENTS

| | | | | |
|---|---|---|---|---|
| 4,427,722 A | | 1/1984 | Keller | 427/420 |
| 4,441,263 A | | 4/1984 | Vedenpää | 34/115 |
| 4,761,309 A | | 8/1988 | Embry | 427/294 |
| 5,105,758 A | | 4/1992 | Kozak | 118/300 |
| 5,509,161 A | | 4/1996 | Neveu et al. | 8/151 |
| 5,660,882 A | * | 8/1997 | McBride et al. | 427/294 |
| 5,763,013 A | | 6/1998 | Devine et al. | 427/420 |
| 6,187,142 B1 | | 2/2001 | Heinzmann et al. | 162/135 |

FOREIGN PATENT DOCUMENTS

| | | |
|---|---|---|
| DE | 57 317 | 8/1967 |
| DE | 41 40 652 A1 | 6/1993 |
| DE | 43 14 475 A1 | 12/1993 |
| DE | 0 740 197 | 4/1995 |
| DE | 195 46 697 A1 | 6/1997 |
| DE | 19903559 | 1/1999 |
| DE | 198 23 738 A1 | 11/1999 |
| DE | 10057731 | 11/2000 |
| DE | 100 12 256 A1 | 9/2001 |
| EP | 0 678 614 | 4/1995 |
| JP | 10277458 A | 10/1998 |

* cited by examiner

*Primary Examiner*—Laura Edwards
(74) *Attorney, Agent, or Firm*—Taylor & Aust, P.C.

(57) ABSTRACT

An apparatus for applying liquid or pasty application medium, in particular aqueous pigment suspension, to one or both sides of a moving material web, especially to a paper or board web, during its production and/or finishing. The invention provides for the vacuum generating device to be assigned to that side of the material web which faces away from the application medium curtain, at least to the region of incidence of the application medium on the material web.

4 Claims, 1 Drawing Sheet

APPLICATOR

BACKGROUND OF THE INVENTION

1. Field of the Invention

The present invention relates to an apparatus for applying liquid or pasty application medium, in particular aqueous pigment suspension, to one or both sides of a moving material web, especially to a paper or board web, during its production and/or finishing 2. Description of the Related Art Machines for the production and/or finishing of a material web, in particular a paper or board web, have widths of up to 10 m and more nowadays. In the case where the material web is coated by way of an application medium curtain, a uniform application reaching over the entire web width is to be ensured. This requirement is more difficult to realize the faster the material webs run in the machines and, in addition, also depends on the quality of the material web and the application medium.

Coating with a "curtain coater", that is to say an application medium applicator unit, is carried out without any excess of medium. The amount of medium applied is only that which is also intended to remain on the material web. The film applied is therefore very thin.

Depending on the quality of the material web used, the formation of microscopically uncovered points therefore occurs ("micro-skip coating"), the aforementioned very thin liquid film tearing at locations with projecting paper fibers, roughness or pores. At these locations, which are different in point terms, the homogeneous contact between medium and substrate (material web) is lacking.

In order to counter this problem, one solution for the electrostatic charging of the material web and/or the application medium and/or the applicator unit has been proposed in DE 100 12 256. DE 100 57 731 is likewise concerned, among other things, with the problem of the more uniform wetting of the material web to be coated by a curtain applicator unit. In the case of this solution, the arrangement of a vacuum generating device in the form of a suction box is provided in the pocket between the application medium curtain and the material web. In the case of direct application to the material web, the vacuum is intended to promote anchoring of the application medium on the material web. In order to increase its efficiency, the aforementioned suction box is equipped with doctor elements, which are set against the material web, on the inlet side and/or the outlet side (in relation to the direction of the moving material web).

What is needed in the art is a suitable apparatus to improve further the adhesion to a moving material web of the application medium curtain produced by a curtain applicator unit, and to ensure still more uniform wetting of the material web surface.

SUMMARY OF THE INVENTION

The present invention provides a curtain application unit and a vacuum generating device which attracts the application medium to a moving material web.

By producing a vacuum between the already largely dried material web and the wet layer of the application medium, in spite of an inhomogeneous surface of the material web, entirely uniform wetting with application medium can be achieved, so that all the particles, irregularities, pores and the like on or in the material web are reliably covered with application medium.

The vacuum generated and applied to the underside (that is the uncoated side, facing away from the application medium curtain) of the material web needs, however, only to be sufficiently great that the application medium merely rests on the surface of the material web, but does not penetrate the latter.

As a result, the material web becomes more stable and therefore tends far less to the tearing-in effect, which is particularly desirable in the case of webs containing waste paper.

As distinct from a solution for coating a still wet paper or board web running on wires, according to DE 198 23 738, in the case of the solution according to the present invention, no moisture needs to be sucked out of the web. The vacuum only needs to be high enough that it accelerates the adhesion of the application medium to the substrate (that is to say, the material web). It is therefore possible to manage with a very low suction output from the vacuum generating source.

An expedient refinement of the apparatus can consist in the vacuum generating device being constructed as a machine-width, external suction box, which can be fitted under the material web in a straightforward manner and, in addition, may be arranged at the level or at least in the region of the line of incidence or position of incidence P of the application medium curtain. In this manner, the effect with regard to adhesion and wetability may be increased considerably as compared with DE 100 577 318 cited previously.

By way of the sealing elements arranged on the suction box, for example in the form of doctors, brushes or the like set against the material web, the suction action and therefore the adhesion of the curtain can be increased.

For configurations in which the material web is to be coated in the supported state, the support can be provided with a roll or another supporting element. This supporting element can be equipped with a suction zone which has individual suction openings and can be connected to a vacuum generating source.

The apparatus according to the present invention may be used both as an individual apparatus and in combination with the aforementioned solutions.

With the apparatus according to the present invention, sensitive, less strong papers, those with a low grammage or else with a low raw-material quality can be treated particularly advantageously, since there is no stress involved in the application of the medium, but nevertheless good wetability is provided.

Following the treatment with the apparatus according to the present invention, further conventional treatment steps, such as further coatings to produce a multiple coating, with and without intermediate drying, calendering and so on may follow.

For completeness, mention should be made of the fact that the web can subsequently be coated on the second side as well. However, the apparatus according to the present invention is then less effective, since the suction action is then reduced because of the coating of the first web side. In the case of paper webs with a low grammage, however, this should be feasible.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
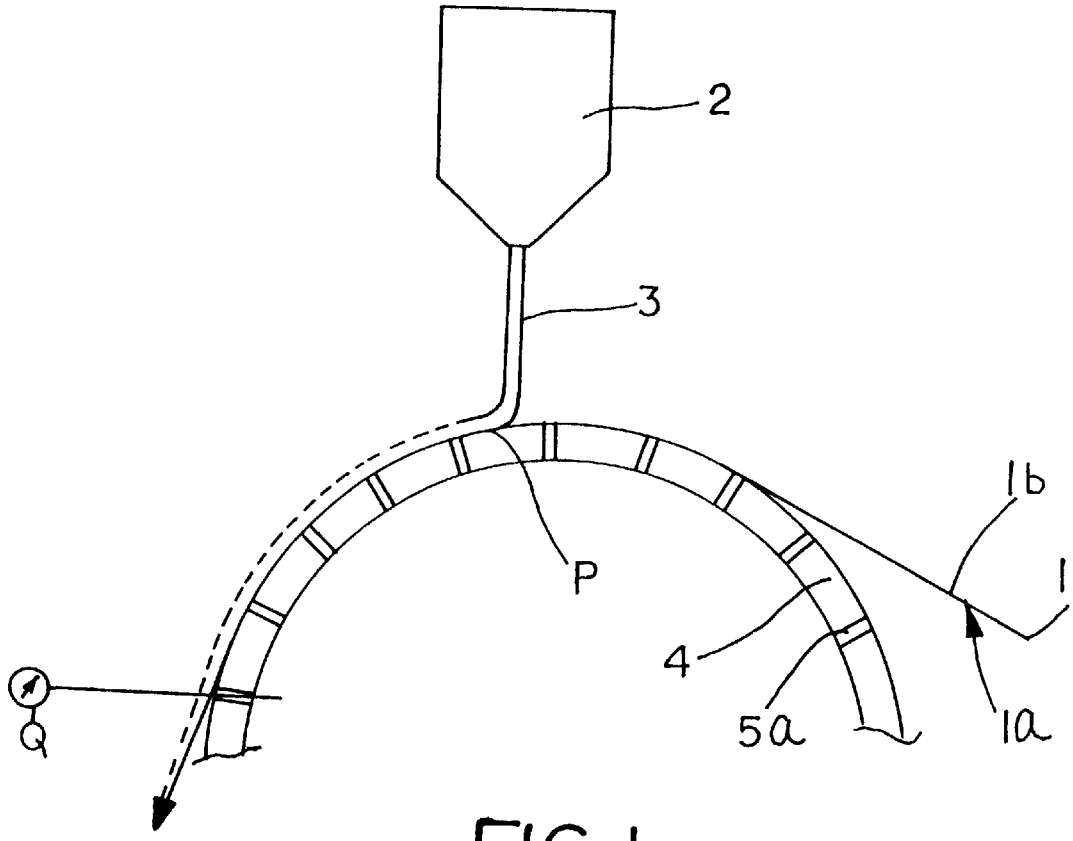
FIG. 1 is a partially schematic cross-sectional view of a first embodiment of the present invention.
Figure 2:
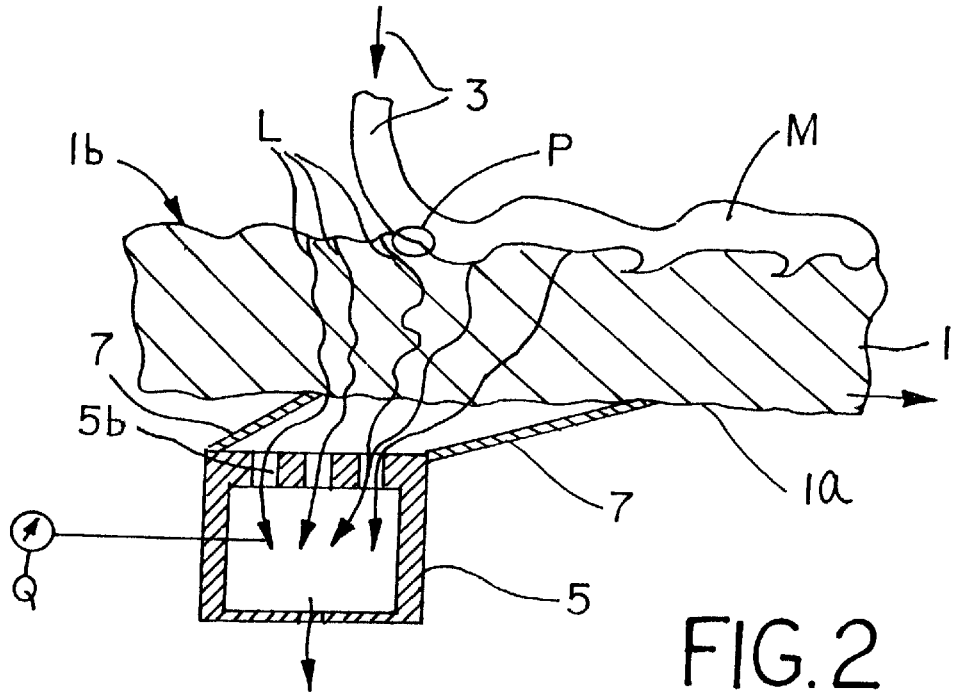
FIG. 2 is a partially schematic cross-sectional view of a second embodiment of the present invention.

Referring now to the drawings, and more particularly to FIGS. 1 and 2, there is shown a web application subsystem of a paper or board making machine which generally includes a material web 1, curtain applicator unit 2, application medium curtain 3, roll 4 and vacuum generating device 5.

FIGS. 1 and 2 each show a paper or board web 1 with a dryness content of >80%. As indicated by a direction arrow, it runs from a drying section, not illustrated in the drawings, to a machine-width curtain applicator unit 2, which discharges an application medium curtain 3 over the entire width of material web 1. Curtain 3 directly strikes web side 1*b* provided for the coating at position P.

Web 1 has a thickness of 50–200 $\mu$m, whereas the layer produced by curtain 3 has a thickness of 5–50 $\mu$m.

FIG. 1 reveals that web 1 is supported by roll 4. Roll 4, over which the uncoated side 1*a* of web 1 runs, is provided with a vacuum generating device 5, such that roll 4 has a suction zone 5*a* which is connected to a controllable vacuum source Q. The design of such suction zones and suction rolls is adequately well known and therefore requires no more detailed explanation. In another embodiment the support could also consist of a perforated supporting belt (not shown), with a suction box as illustrated in FIG. 2.

FIG. 2 shows the coating of web 1, illustrated in a free (unsupported) draw. Applicator unit 2 has not been shown here for reasons of simplicity. The web 1 and also the application medium applied by the curtain 3 are shown greatly enlarged here for reasons of clarity.

The uncoated web side 1*a* is assigned a known suction box 5*b* in the region of the point of incidence P located suction box 5*b*. Suction box 5*b* sucks air L through the porous web 1 and, as a result, attracts the curtain 3 falling down onto the active side of suction box 5 towards web side 1*b*. As a result, the desired anchoring of curtain 3 to web side 1*b* takes place and, in addition, it is ensured that there is a uniform distribution and wetting of the application medium M over the entire web width.

In order to improve its suction action, the suction box 5*b* is provided with sealing elements 7 at its end on the feed and discharge sides. The sealing element considered is both brushes set against web side 1*a* and flexible or rigid doctor strips. The flexible or rigid doctor strips may make contact with the web side 1*a* or else be arranged at a short distance from it.

With the apparatus according to the present invention, sensitive, less strong papers, those with a low grammage or else with a low raw-material quality can be treated particularly advantageously, since there is no stress involved in the application of the medium, but nevertheless good wetability is provided.

Following the treatment with the apparatus according to the present invention, further conventional treatment steps, such as further coatings to produce a multiple coating, with and without intermediate drying, calendering and so on may follow.

Web 1 can subsequently be coated on the second side as well. However, the apparatus according to the present invention is then less effective, since the suction action is then reduced because of the coating of the first web side 1*b*. In the case of paper webs with a low grammage, however, this should be feasible.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator for applying one of a liquid and pasty application medium to at least one side of a moving fiber material web, said applicator comprising:

a curtain applicator unit for applying a free falling curtain of the application medium moving substantially under the force of gravity and incident on the fiber material web at a region of incidence; and a vacuum generating device for attracting the application medium from said curtain applicator unit to the moving fiber material web, said vacuum generating device being located on the side of the moving fiber material web which faces away from said curtain applicator unit, said vacuum generating device providing a vacuum generally in said region of incidence firmly attaching the application medium to the fiber material web, said vacuum generating device being a stationary suction box having at least one sealing element set against the moving fiber material web.

2. The applicator of claim 1, said suction box including an inlet side and an outlet side, said at least one sealing element positioned at at least one of said inlet side and said outlet side.

3. An applicator for applying one of a liquid and pasty application medium to at least one side of a moving fiber material web, said applicator comprising:

a curtain applicator unit for applying a free falling curtain of the application medium moving substantially under the force of gravity and incident on the fiber material web at a region of incidence; and a vacuum generating device for attracting the application medium from said curtain applicator unit to the moving fiber material web, said vacuum generating device being located on the side of the moving fiber material web which faces away from said curtain applicator unit, said vacuum generating device providing a vacuum generally in said region of incidence firmly attaching the application medium to the fiber material web, said vacuum generating device being a stationary suction box having at least one sealing element set against the moving fiber material web, said sealing element being a doctor element.

4. An applicator for applying one of a liquid and pasty application medium to at least one side of a moving fiber material web, said applicator comprising:

a curtain applicator unit for applying a free falling curtain of the application medium moving substantially under the force of gravity and incident on the fiber material web at a region of incidence; and a vacuum generating device for attracting the application medium from said curtain applicator unit to the moving fiber material web, said vacuum generating device being located on the side of the moving fiber material web which faces away from said curtain applicator unit, said vacuum generating device providing a vacuum generally in said region of incidence firmly attaching the application medium to the fiber material web, said vacuum generating device being a stationary suction box having at least one sealing element set against the moving fiber material web, said sealing element being a brush.

* * * * *